US009802249B2

(12) United States Patent
Nitzl et al.

(10) Patent No.: US 9,802,249 B2
(45) Date of Patent: Oct. 31, 2017

(54) CERAMIC REFRACTORY STOPPER

(71) Applicant: REFRACTORY INTELLECTUAL PROPERTY GMBH & CO. KG, Vienna (AT)

(72) Inventors: Gerald Nitzl, Baden (AT); Arno Stranimaier, Trieben (AT); Hans-Jürgen Haslinger, Trieben (AT); Helmut Kaufmann, Gaishorn am See (AT)

(73) Assignee: REFRACTORY INTELLECTUAL PROPERTY GMBH & CO. KG, Vienna (AT)

( * ) Notice: Subject to any disclaimer, the term of this patent is extended or adjusted under 35 U.S.C. 154(b) by 267 days.

(21) Appl. No.: 14/347,818

(22) PCT Filed: Mar. 22, 2013

(86) PCT No.: PCT/EP2013/056082

§ 371 (c)(1),
(2) Date: Mar. 27, 2014

(87) PCT Pub. No.: WO2013/156252

PCT Pub. Date: Oct. 24, 2013

(65) Prior Publication Data

US 2014/0232047 A1 Aug. 21, 2014

(30) Foreign Application Priority Data

Apr. 16, 2012 (EP) ..... 12164338

(51) Int. Cl.
*B22D 41/18* (2006.01)

(52) U.S. Cl.
CPC ..... *B22D 41/186* (2013.01)

(58) Field of Classification Search
CPC ..... B22D 41/186; B22D 41/18; B22D 41/20; B22D 41/08; B22D 41/16; B22D 41/58
USPC ..... 266/220, 217, 266; 222/590, 602, 603, 222/591, 594, 597
See application file for complete search history.

(56) References Cited

U.S. PATENT DOCUMENTS

| | | | | |
|---|---|---|---|---|
| 7,910,050 B2 * | 3/2011 | Winkelmann | ..... | B22D 41/186 222/602 |
| 2007/0210494 A1 * | 9/2007 | Guillo | ..... | B22D 41/186 266/217 |
| 2008/0106011 A1 * | 5/2008 | Lee | ..... | B22D 41/186 266/272 |

FOREIGN PATENT DOCUMENTS

| | | |
|---|---|---|
| JP | H10113752 A | 5/1998 |
| WO | 2006136285 A2 | 12/2006 |

OTHER PUBLICATIONS

International Search Report for PCT/EP2013/056082 dated Apr. 25, 2013.

* cited by examiner

*Primary Examiner* — Scott Kastler
*Assistant Examiner* — Michael Aboagye
(74) *Attorney, Agent, or Firm* — Medley, Behrens & Lewis, LLC

(57) ABSTRACT

The invention relates to a ceramic refractory stopper (a stopper device) for controlling a flow of molten metal at an outlet opening of a metallurgical vessel, such as a tundish.

14 Claims, 1 Drawing Sheet

CERAMIC REFRACTORY STOPPER

TECHNICAL FIELD

The invention relates to a ceramic refractory stopper (a stopper device) for controlling a flow of molten metal at an outlet opening of a metallurgical vessel, such as a tundish.

BACKGROUND

The generic type of ceramic refractory stoppers comprises a rod-shape stopper body, one end of which being designed for fixation to a corresponding lifting mechanism, while the other end of which being defined by a so called stopper head. The rod-shaped stopper body typically has a central longitudinal axis.

It is well known in steel casting to arrange such a stopper rod, which in many cases is a one-piece-stopper rod, in a vertical position, in order to vary the cross-sectional area of an associated outlet opening of a corresponding metallurgical vessel by said lifting action. Insofar any directions disclosed hereinafter, like "top", "bottom", "upper and lower ends" always refer to the vertical use position as shown in the Figures of the attached drawing.

Stopper rods of this type have also been used to introduce a treatment gas, such as an inert gas, i.a. argon, into the hot melt (in particular steel melt) to improve the quality of the melt, for example to remove non-metallic inclusions from the melt.

Insofar reference is made to WO 2006/007672. The known stopper rod comprises:

- a rod-shaped stopper body defining a central longitudinal stopper axis, including
- at least one fitting for connecting the stopper rod to a gas supply line, and
- at least one gas channel, running within said stopper body, from an upper end of the stopper body toward an opposite end of the stopper body and extending into a free outer surface area of a stopper head.

According to WO 2006/007672 it has been observed that the gas may be contaminated during its passage through the gas channel of the stopper rod.

To overcome this drawback WO 2006/007672 discloses a stopper rod, wherein the wall of the gas channel is provided with a layer of a material which does not produce carbon monoxide at the temperature of use.

It was found that the contamination of the treatment gas cannot be avoided reliably by said inner lining. The reasons are not yet fully understood but include:

- the gas (for example Argon, Nitrogen) may still be contaminated by small particles of the lining material, for example by abrasion and/or chemical reaction between the gas (for example in case of Nitrogen) and the lining material.
- Without said lining the same problems arise with respect to the refractory material of the stopper rod.
- Temperature differences within the stopper rod and/or the gas channel respectively may cause
  - condensation effects of the treating gas which changes the gas quality arbitrarily and
  - depositions onto the wall of the gas channel.

This is especially true in cases where parts of the stopper rod are immerged in a hot melt and other parts of the stopper rod project above the melt into a much cooler environment.

Further the known technology does not consider harmful constituents of the treatment gas, for example SiO, other volatile sub-oxides, alkali-compounds or the like which may contribute a blockage of the gas-channel(s) in the stopper head.

SUMMARY

The object of the invention is to provide a stopper rod of the type mentioned. overcoming these disadvantages. The invention is based on the following cognition:

The effects mentioned are totally different. While the abrasion problem ($1^{st}$ problem) is a problem of the material from which said stopper is manufactured the $2^{nd}$ problem (temperature gradient) is caused by the application of said stopper rod, Insofar any changes in the material of the stopper rod may solve the $1^{st}$ but not the $2^{nd}$ problem and vice versa any external heating of the stopper area may reduce the temperature gradient but not, the abrasion problem.

The invention makes a totally different approach: It accepts the 2 problems mentioned but compensates these problems by filling a solid material (hereinafter also called the filling material) into the gas channel while leaving enough space for the gas to pass through, which material provides the following effects:

a) it is high-temperature resistant (>1000° C., >1,300° C., often >1500° C. or >1600° C.) and therefore remains in the gas channel e.g. during use of the stopper rod in a bath of molten steel of a similar temperature.

b) it characteristically enlarges the surface area along which the gas flows on its way through the gas channel and at the same time makes the surface labyrinth (meander) like.

c) any abrasives from the material of the stopper body or from the filling material itself can be collected within the corresponding filler zone of the gas channel.

Criterion a) is important to allow the filling material to fulfil its function during use of the stopper rod.

Criterion b) is important as the new surfaces force the gas to transverse flows (up to small turbulences). The filling material further achieves (gets) a temperature similar to the temperature of the stopper body, when the stopper rod is in use, thus leading to additional heating surfaces for the gas, an increase of the gas temperature and an equilization the gas temperature over the respective parts of the gas channel and further downstream toward the outlet section of the gas channel. The heat transfer is mainly effected by thermic radiation.

Any temperature difference between the material of the stopper body and the gas is favorably reduced. This is true although the gas velocity increases in view of the reduced cross section available for the gas to flow through (under the assumption of a certain gas volume necessary for the treatment of the melt).

This criterion (b) is linked with the demand to secure that the gas passes that distance (part) of the gas channel filled with this material in an appropriate volume and implicitly includes a corresponding selection of suitable filling materials and suitable shapes.

A powdery material would cause blockage of the gas channel and avoid the necessary gas volume to pass through. A particulate material or a material with a high open porosity necessarily provides gaps and/or hollows and/or slits and/or spaces like pores between adjacent particles and/or within the material through which the gas may flow, i.e. such materials have a considerable "open porosity" or "permeability to gas", which may be adjusted according to a range necessary to let the required volume of gas pass through.

The criterion is improved if the filling material has a high thermal conductivity. The filling material then receives and transports the heat even more efficiently. The filling material receives its high temperature by direct heat conduction from the corresponding melt, into which the stopper is immerged, via the stopper body as well as by heat radiation from the stopper body.

The filling material must extend over a considerable distance (length) of the gas channel in order to provide the desired new large surface areas and to achieve the desired effects.

As a result the gas temperature is not only higher but much more uniform in a stopper rod according to the invention compared with prior art devices.

A further advantage is that condensation effects of the gas are reduced or even avoided.

With respect to criterion c) this "packed bed" (filling) acts as a collecting chamber for any abrasions from the refractory material or any lining or glaze respectively and avoids that corresponding dust and/or particles follow the gas stream along the gas channel toward the gas outlet opening with the danger of blockage of the gas channel by clogging effects. This is particularly important with stopper rods having a gas outlet opening of reduced diameter—compared with its upstream sections—like typically being the case at the stopper head.

In other words: Even in case abrasion may not be avoided completely the invention may compensate said abrasion by providing a filler material which "absorbs" (collects) any such solid materials. Such particles may physically adhere to the filling material or react with it.

In its most general embodiment the invention relates to a ceramic refractory stopper, comprising

- a rod-shaped stopper body defining a central longitudinal stopper axis
- at least one fitting for connecting a gas supply line,
- at least one gas channel of a total length L within said stopper body, extending between an inlet section at a first end of the stopper body and an outlet section in a free outer surface area at a second end of the stopper body, which second end defining a stopper head, wherein
- a high temperature resistant material is arranged within the gas channel according to the following conditions:
- the high temperature material extends along a distance R of the gas channel being ≥25% of the total length L of the gas channel and
- solid parts of the high temperature resistant material infill between 10 and 90% by volume of the gas channel along said respective distance R.

The distance of that part of the gas channel filled with the material is decisive to achieve the advantages mentioned and therefore it may exceed 30% (or may be >40%, >50%, >60%, >70%) of the total length of the gas channel, in principle a longer filler path will lead to better results, but at the same time the type and amount of the filler material must be selected carefully to secure that the required gas stream may pass the stopper without any disadvantageous pressure losses.

The filler material may be arranged parallel to the central longitudinal stopper axis of the stopper rod.

According to an embodiment at least 20% of said gas channel volume (calculated without any filler material therein) are filled with solid parts of said high temperature resistant material, including percentages of >25%, >30%, >40%, >50% to achieve the improvements. For sake of clarity, any open porosity within the solid parts of the filling material, through which gas flows, does not define the "solid volume" of the filling material.

If the gas channel has parts with a smaller cross-section (especially parts with a cross section smaller than—for example—the grain size of a particulate filling material, so that the filling material doesn't fit in; this may be the case especially in the stopper head) the filling material will only be implemented in those part of the gas channel of larger cross-section to avoid any undesired blockage.

Typically the gas channel has a cylindrical shape although other designs are possible.

To achieve the metallurgical effects in the metal bath a certain volume (amount) of gas is necessary. In typical metallurgical applications said part of the gas channel, filled with the particulate material, may have a cross-section of >500 $mm^2$.

The selection of a suitable filling material should account for the following properties (alternatives in brackets):

- thermal capacity, established in accordance with EN 993-14, EN 993-15 of more than 0.4 J/g K [0.8-5.0 J/g K].
- thermal conductivity established in accordance with EN 993-4, EN 993-15 of more than 0.04 W/mK [>0.5 or >1.0 to <5 or <10 with a maximum 25 W/m K]
- temperature resistance of more than 1000° C. (>1500° C.)
- gas permeability, established in accordance with EN 993-4, of less than $1\times10^{-13}$ $m^2$.
- abrasion resistance: The filling material should not loose more than 10M.-% (better <5M.-% or <1M.-%) by abrasion during its maximum time of use.

The more properties the material exhibits the more suitable it is to be used as a filling material in a stopper rod according to the invention.

The filling material may be selected from the group comprising: charcoal, oxidic refractory materials, non-oxidic refractory materials, graphite felts, or mixtures thereof.

A particulate filling material may be provided as a preparation of any two- or three-dimensional shapes, including: granules, pellets, fibres, pyramids, cones and/or spheres.

It may be prepared as particles with a grain size between 1 and 10 mm, for example [[a]] grain size $d_{90}$ between 2 mm and 8 mm or between 2 mm and 5 mm, meaning that 90% of the particles fall within said range. In case of fibres a length up to 30 mm and an average diameter <100 μm is suitable.

The term "particulate material" includes a shaped material with a corresponding open pore-volume (open porosity) and gas permeability. This may be, as an example, a foamed ceramic shape.

According to an embodiment the filling material may be arranged as one continuous filling, i.e. like/as a cartridge, a column or the like within the gas channel. The invention includes the possibility to arrange/integrate two or more continuous fillings in a stopper rod, with a clearance between the respective fillings. A cartridge may be designed as an envelope surrounding a loose (particulate) filling material or as a shaped body.

It may be helpful, especially under extreme conditions, to provide a cover at least on top of one of the free end sections of the filling, wherein the cover is a high temperature resistant, gas permeable filter with free spaces for the gas to pass through being smaller than those of the filling material. This filter cover serves to avoid any solid particles from the refractory material or the filling material to enter downstream sections of the gas channel and it especially avoids any such solids from entering in the gas outlet region of the gas channel. The filter typically extends over the whole cross section of the gas channel. Its gas permeability is less (for example >10%, >20%, >40% less) than that of the filling material.

This gas permeable filter can be made of high temperature resistant fibres, for example alumina fibres.

Further features of the invention will derive from the subclaims and the other application documents. The stopper may be realised by arbitrary combinations of the design features disclosed, if such combinations are not explicitly excluded.

It should be noted that terms like "rod-shaped" etc., cylindrical, concentric, parallel etc. always refer to the manufactured technical product and insofar refer to corresponding technical features and are not used in a strongly mathematical sense.

BRIEF DESCRIPTION OF THE DRAWINGS

The invention will now be described with respect to the attached schematic drawing, showing in.

DETAILED DESCRIPTION

Figure 1:
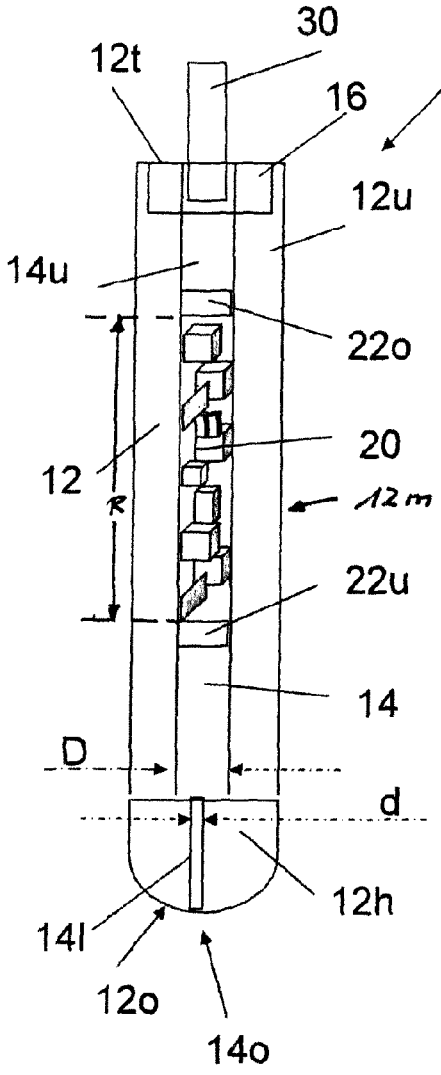
FIG. 1: A sectional view of a first embodiment of new stopper.

FIG. 1 shows a longitudinal sectional view of a stopper rod 10 according to the invention in its working position. In accordance with prior art it is made of a refractory ceramic stopper body 12, shaped as a rod, comprising a substantially cylindrical main section 12*m* (in FIG. 1 the upper section) and a head section 12*h* at its lower end, typically called a stopper head.

The rod-shaped stopper body 12 defines a central longitudinal stopper axis A (FIG. 2) and comprises a cylindrical gas channel 14, running within said stopper body 12, concentrically with respect to axis A, from an upper end 12*u* of stopper body 12 toward said stopper head 12*h* (thus defining an upper section 14*u* of cylindrical gas channel 14 of inner diameter D) and extending into said stopper head 12*h* and finally extending into a free outer surface area 120 of said stopper head 12*h* (thus defining a lower section 14*l* of cylindrical gas channel 14 of inner diameter d).

At its upper end 12*u* a metallic fitting 16 is arranged around said gas channel 14 within the refractory ceramic material.

Said fitting 16 comprises an inner thread for a form-fit connection to a gas supply line 30.

While total length of said gas channel 14 between a free top surface 12*t* and its outlet opening 14*o* at the lower end of stopper 10 is defined as L, about 0.4 L (represented in FIG. 1 as distance R) of said gas channel are filled with a particulate charcoal, schematically illustrated by cuboids 20.

The distance R, and insofar the height of the filler material 20 in the gas channel 14 is defined at its upper and lower end by a fibre filter 22*o,u* shaped as plates, wherein the cross section of said filter plates 22*o,u* is slightly larger than the said diameter D to keep the filters 22*o,u* (with the charcoal in between) at place (by friction).

This arrangement may be compared with a cartridge and indeed one option to arrange the said particulate material within gas channel 14 is to prepare the filler material like a cartridge, which cartridge being made of a cylindrical envelope, for example made of paper and limited at its ends by said filter plates.

During use the envelope may burn off, while the said filter plates 22*o,u* are made of ceramic fibres, which withstand the temperatures within said stopper rod during use, as the charcoal does.

The example according to FIG. 1 is characterized by the following dimensions after final preparation for use (possible alternatives with typical upper and lower limitations, valid as well for other embodiments and other filler materials are stated in brackets, although data outside these ranges do fall as well under the general idea of the invention):

L=1065 mm [800 to 1200 mm]
D=28 mm [20 to 50 mm]
d=2 mm [1 to 6 mm]
particle size of filler material: $d_{90}$=3.0 mm [$d_{90}$=2 to 6 mm]
bulk density of charcoal: 0.2 kg/m$^3$ [0.1-0.6 kg/m$^3$]
thermal conductivity of filler material: 1 W/mK
thermal capacity of filler material: 1 J/gK In a practice test with this stopper it could be proved that the desired gas flow (Argon: 9 l/min) could be maintained over the complete period of use without any distracting back-pressure or other negative effects.

Figure 2:
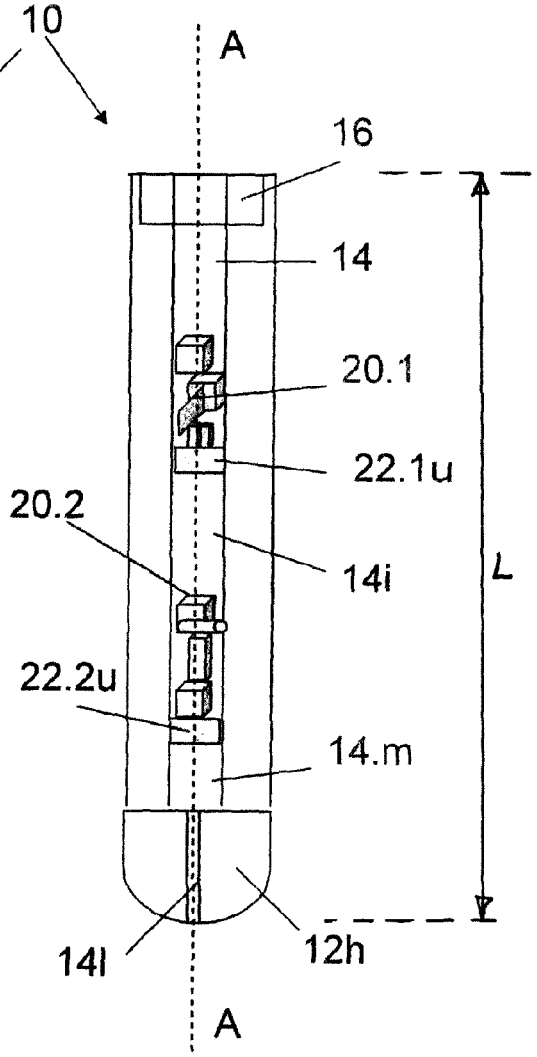
FIG. 2: A sectional view of a second embodiment of the new stopper.

The embodiment according to FIG. 2 is similar to that of FIG. 1 so that only the distinguishing features are described hereinafter:

Instead of one continuous column of filler material (of a length of 0.4 L according to FIG. 1) the embodiment of FIG. 2 comprises two filler section 20.1 and 20.2 (defining 2 cartridges) each roughly of about half the length (0.2 L) of that according to FIG. 1 and each with a filter plate 22.1*u*, 22.2*u* only at its lower end.

Accordingly a space 14*i* defined by a corresponding section of the gas channel 14 is arranged between both said filler sections 20.1, 20.1 and a gas channel section 14*m* is defined between filter 22.2*u* and gas channel section 14*l*.

Finally a particulate MgO sinter material is used instead of charcoal (according to the example of FIG. 1) and the filter is made of mineral fibres.

In other words, the gas, entering the gas channel 14 at fitting 16 takes the following way toward outlet opening 14*o:* gas channel section 14*u*
MgO (filler) section 20.1
filter plate 22.1*u*
gas channel section 14*i*
MgO (filler) section 20.2
filter plate 22.2*u*
gas channel section 14*m*
gas channel section 14*l*
outlet opening 14*o*.

The filler section(s) are responsible to achieve the following characteristics:

a redirection of the gas flow
an increased hot solid surface in contact with the gas
a more or less uniform temperature of the treatment gas (here: Argon) within gas channel 14
no relevant condensations of treatment gas along gas channel 14
any abrasions and/or other solid impurities are collected within said filler sections and/or the adjacent filter plates and hindered to enter into gas channel section 14*l* of reduced diameter.

The invention claimed is:

1. Ceramic refractory stopper, comprising a) a rod-shaped stopper body (12) defining a central longitudinal stopper axis (A) including:

b) at least one fitting (16) for connecting a gas supply line (30), and c) at least one gas channel (14) of a total length (L) within said stopper body (12), extending between an inlet section at a first end (12*u*) of the stopper body (12) and an outlet section in a free outer surface area (12*o*) at a second end of the stopper body, which second end defining a stopper head (12*h*), wherein d) a filling material is arranged within the gas channel (14) according to the following conditions:

e) the filling material is a high temperature resistant and particulate material which is defined by solid parts and an open porosity, and arranged as a packed bed which extends along a distance (R) of the gas channel (14) being ≥25% of the total length (L) of the gas channel (14) and f) said solid parts of the high temperature resistant and particulate material infill between 10 and 90% by volume of the gas channel (14) along said respective distance (R).

2. Ceramic refractory stopper according to claim 1, wherein the gas channel (14) extends along more than 50% of its total length (L), parallel to the central longitudinal stopper axis (A).

3. Ceramic refractory stopper according to claim 1, wherein the gas channel (14) has a smaller cross-section at its part (14*l*) within the stopper head (12*h*) and the high temperature resistant and particulate material (20) is only present in the remaining part (14*u*, 14*m*) of the gas channel (14) of larger cross-section.

4. Ceramic refractory stopper according to claim 1, wherein the gas channel (14) has a cylindrical shape.

5. Ceramic refractory stopper according to claim 1, wherein said part of the gas channel (14*u*, 14*m*), filled with the high temperature resistant and particulate material, has a cross-section of >500 $mm^2$.

6. Ceramic refractory stopper according to claim 1, wherein the high temperature resistant and particulate material (20) is selected from the group complying with at least one of the following properties:

a) thermal capacity, established in accordance with EN 993-14,15 of more than 0.4 J/gK b) thermal conductivity, established in accordance with EN 993-14,15 of more than 0.04 W/mK c) temperature resistance of more than 1000° C.

7. Ceramic refractory stopper according to claim 1, wherein the high temperature resistant and particulate material is selected from the group consisting of: charcoal, oxidic refractory materials, and non-oxidic refractory materials.

8. Ceramic refractory stopper according to claim 1, wherein the high temperature resistant and particulate material (20) is provided by particles with a grain size d90 of 1-10 mm.

9. Ceramic refractory stopper according to claim 1, wherein the high temperature resistant and particulate material (20) is arranged as one continuous filling.

10. Ceramic refractory stopper according to claim 1, wherein the high temperature resistant and particulate material (20) is arranged as two or more continuous fillings (20.1, 20.2) with a clearance (14*i*) between the respective fillings (20.1, 20.2).

11. Ceramic refractory stopper according to claim 1, wherein the high temperature resistant and particulate material (20) is covered, as least at one of its free ends, by a high temperature resistant, gas permeable filter (22*u*, 22*o*, 22.1*u*, 22.2*u*).

12. Ceramic refractory stopper according to claim 1, wherein the solid parts of the high temperature resistant and particulate material infill between 20 and 60% by volume of the gas channel (14) along said respective distance (R).

13. Ceramic refractory stopper according to claim 1, wherein the high temperature resistant and particulate material extends along a distance (D) of the gas channel (14) being ≥50% of the total length (L) of the gas channel (14).

14. Ceramic refractory stopper according to claim 1, wherein the high temperature resistant and particulate material (20) is provided as a preparation comprising: three-dimensional shapes, granules, pellets, fibres, pyramids, cones, spheres.

* * * * *